United States Patent [19]

Lee

[11] Patent Number: 4,828,256

[45] Date of Patent: May 9, 1989

[54] BARBELL

[76] Inventor: Suk Young Lee, No. 420-4, Bisan-Dong, Anyang-Shi, Kyeonggi-Do, Rep. of Korea

[21] Appl. No.: 51,089

[22] Filed: May 15, 1987

[30] Foreign Application Priority Data

Jun. 9, 1986 [KR] Rep. of Korea ..... 4558

[51] Int. Cl.[4] ..... A63B 13/00

[52] U.S. Cl. ..... 272/123; 272/117; 272/127

[58] Field of Search ..... 272/117, 122, 123, 124, 272/127, 128, 143, 67, 68

[56] References Cited

U.S. PATENT DOCUMENTS

| | | | |
|---|---|---|---|
| 2,676,802 | 4/1954 | O'Brien | 272/128 X |
| 3,482,832 | 12/1969 | Dean | 272/128 X |
| 3,617,056 | 11/1971 | Herbold | 272/128 X |
| 3,679,204 | 7/1972 | Busby | 272/123 |
| 3,758,109 | 9/1973 | Bender | 272/123 |
| 3,843,117 | 10/1974 | Johnson | 272/128 |
| 4,231,569 | 11/1980 | Rae | 272/122 |
| 4,252,316 | 2/1981 | Price | 272/123 |
| 4,274,628 | 6/1981 | Hoagland | 272/123 |
| 4,288,073 | 9/1981 | Petrachonis et al. | 272/123 |
| 4,377,282 | 3/1983 | Hayes | 272/128 X |
| 4,406,452 | 9/1983 | Lapcevic | 272/123 |
| 4,455,020 | 6/1984 | Schnell | 272/123 |
| 4,505,474 | 3/1985 | Mattox | 272/117 X |
| 4,664,373 | 5/1987 | Hait | 272/117 |
| 4,711,449 | 12/1987 | Ochab | 272/123 |
| 4,717,147 | 1/1988 | Rochelle | 272/117 |

FOREIGN PATENT DOCUMENTS

| | | | |
|---|---|---|---|
| 3211825 | 10/1983 | Fed. Rep. of Germany | 272/122 |
| 524174 | 5/1921 | France | 272/122 |
| 58-8273 | 2/1983 | Japan . | |
| 60-41248 | 12/1985 | Japan . | |
| 550961 | 2/1943 | United Kingdom | 272/122 |

*Primary Examiner*—Richard J. Apley
*Assistant Examiner*—Robert W. Bahr
*Attorney, Agent, or Firm*—Ladas & Parry

[57] ABSTRACT

A barbell comprises a bar 1 and a weight 2 mounted on the bar by the bar passing through a central hole in the weight. Hand-grip regions 3 of the bar are adapted to be gripped by the user during exercise, the hand-grip regions being positioned one on each side of the weight. The weight is elongate along the length of the bar and roughly square-shaped in cross-section, to allow the bar to pass close to the chest of the user during use. The center of gravity of the weight is displaced from the axis of the bar sufficiently for the weight to rotate relative to the bar during lifting by the user so as to avoid the twisting force of the weight due to its moment of inertia being transferred to the wrists of the user.

3 Claims, 2 Drawing Sheets

BARBELL

The present invention relates to a barbell for use in weight lifting exercises.

Two types of barbell are known in the art. A first type is a large barbell used by a professional sportsman, which comprises a bar and a plurality of large, disc-shaped weights, which are spaced apart in two equal groups attached one at each end of the bar and locked to the bar by locking devices. A second type is a relatively small barbell used by an amateur or beginner, which is smaller in size than the large barbell. The smaller barbell has its two weights (similar to those of the large barbell) closely disposed to its central part, and locked to the bar by locking devices. The bar of the smaller barbell is grasped by the hands of the user, one at each end of the bar, while the bar of the large barbell is grasped by the hands of the user at a central part of the bar.

Potential problems associated with these known barbells, especially with the small barbells, are that they are very inconvenient for exercising with. With the smaller type of barbell, the bar of the weights is unable to reach satisfactorily across the shoulders or the chest, when lifted by bending the arms, for the reason that the disc-shaped weights contact the shoulders or chest before the bar does. Known barbells are unsafe when dropped or laid down on theh floor from the hands (especially on an inclined floor) for the reason that the round disc-shaped weights roll on the floor like a wheel. Known barbells take up a large space while they are being stored for the reason that disc-shaped weights are bulky in volume.

Finally a problem may arise in that weights may apply a twisting force to the wrists of the exerciser by their moment of inertia when rotated by the effect of the bending of the arms when the weights are lifted to the shoulders. This shock to the wrists arises when the weights are fixed to the bar, or when they are too tight to rotate around the bar even though they are loose fitted to the bar. This latter effect arises for the reason that the energized moment of inertia of the weights cannot overcome the friction force between the bar and the weights.

According to the present invention there is provided a barbell comprising a bar, a weight mounted on the bar, hand-grip regions of the bar adapted to be gripped by the user during exercise, the hand-grip regions being positioned one on either side of the weight, the weight being shaped in such a manner as to allow the bar to pass close to the chest of the user during use.

Preferably the weight is elongate along the direction of the bar.

Preferably the weight is shaped with a flattened surface portion to allow the bar to pass close to the chest of the user during use.

In a particularly preferred form the weight has over at least a part of its length along the direction of the bar a substantially polygonal cross-section, preferably a substantially rectangualr cross-section, and most preferably a substantially square cross-section. Such a cross-section may include longitudinal grooves along the direction of the bar, each groove being positioned along the centre of one face of the cross-section, so as to give the effect of projections of the weight outwardly from the centre of the weight.

Preferably the outer shape of the weight in cross-section is substantially constant along the length of the weight in the direction of the bar.

In accordance with a particularly preferred feature of the invention, the weight is capable of rotary movement relative to the axis of the bar, and the centre of gravity of the weight is displaced from the axis of the bar sufficiently for the weight to rotate relative to the bar during lifting by the user. The object of this arrangement is to avoid or reduce the twisting force of the weight due to its moment of inertia, being transmitted to the wrists of the user.

Preferaby the centre of gravity of the weight is displaced by an amount such that the rotary force of the weight due to its moment of inertia is just sufficient during lifting by the user to overcome friction between the weight and the bar.

The displacement of the centre of gravity may be produced in a number of ways, for example by the cross-section of the bar being non-symmetrical, and/or by the bar being off-set from the centre of symmetry of a symmetrical weight. However, in a particularly preferred form, there is included in the weight a cavity displaced from the axis of the bar to produce the required displacement of the centre of gravity.

In addition to the features of the invention set out above, there are provided a number of further independent aspects of the invention.

In accordance with one further aspect of the invention, there is provided a barbell comprising a bar and a weight, the weight being elongate along the length of th bar, and/or being substantially polygonal in its cross-section.

In acordance with another aspect of the invention there is provided a barbell comprising a bar, and a weight mounted on the bar, the weight being capable of rotary movement relative to the axis of the bar, and the centre of gravity of the weight beig displaced from the axis of the bar.

It is to be appreciated that in all aspects of the invention, there may be provided more than one weight, or the weight referred to may be formed of a number of components.

An embodiment of the invention will now be described by way of example with reference to the accompanying drawings, in which.

Figure 1:
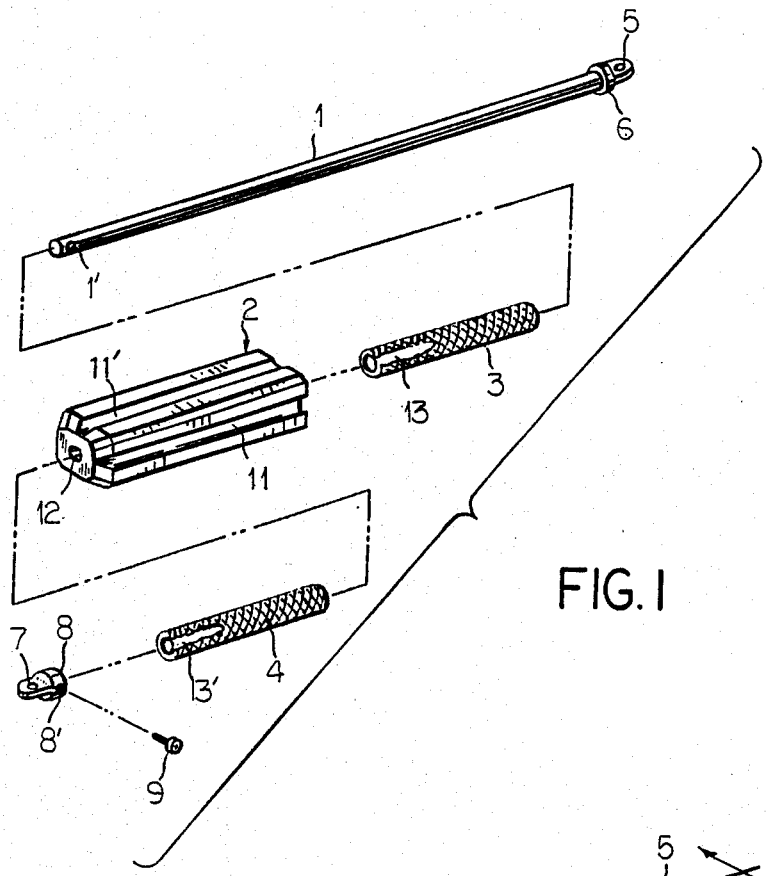
FIG. 1 is a perspective view of the exploded parts of a barbell embodying the present invention.
Figure 2:
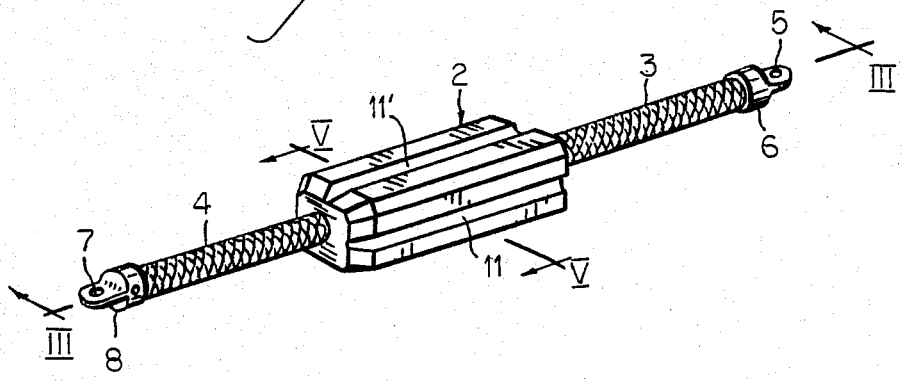
FIG. 2 is a perspective view of the embodiment of the invention assembled.
Figure 3:
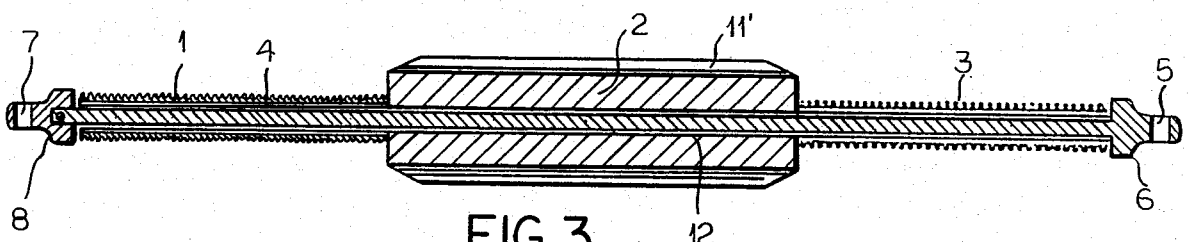
FIG. 3 is a cross-sectional view of the barbell of FIG. 2 taken along the line B—B.
Figure 5:
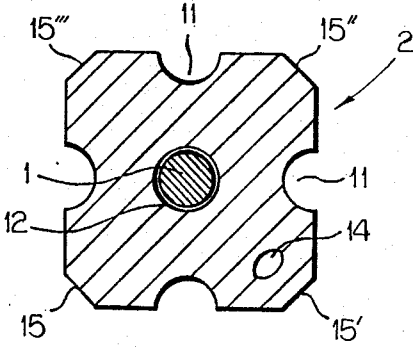
FIG. 5 is a cross-sectional view of the barbell of FIG. 3 taken along the line A—A.
Figure 4:
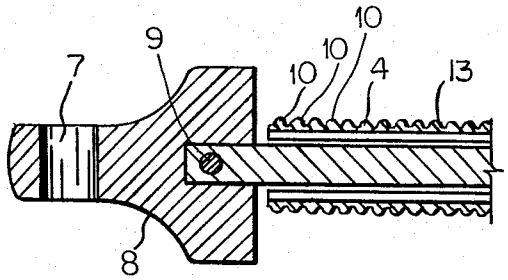
FIG. 4 is an enlarged view of the circled part of FIG. 3.

Referring now to the drawings, in which like numerals refer to like parts, it is seen that a barbell embodying the present invention as shown in FIGS. 1 to 5 includes a long round bar 1 made of metal.

An elongate weight 2 with a central hole 12 has a substantially square shape in cross-section which forms a plurality of weight projections 15, 15', 15'' and 15''' extending longitudinally. A cavity 14 is provided in one of the projections for a purpose to be described hereinafter. The weight is mounted on the bar at its said position by the bar being inserted in the hole 12 with a snug fit, but sufficiently loose to allow rotation of the weight during use, as will be described hereinafter.

The roughly square shape in cross-section of the elongate weight provides a shape giving a short distance from the centre of the bar to the outer edge of the projection of the weight so that it may closely approach the shoulders or chest, when it is lifted to the shoulders. The weight also has a good shape for storing and carrying. The shape includes longitudinal grooves 11 and 11' parallel to the axis of the hole 12, and positioned on the flat side faces of the square section weight.

Two metal tubes 13, 13' covered with knurled-surface plastic grips 3 and 4 are mounted on the ends of the bar 1, one on or each side of the weight.

The weight 2 and the metal tubes 13, 13' are locked by two lock heads 6 and 8 at the ends of the bar 1. One of the heads 6, 8 is permanently attached to the one end of the bar 1 by welding or by a tight fit, and the other is detachably attached to the other end of the bar 1 by a set screw 9 through a pinhole 8'. By this means, the parts of the barbell according to the present invention are easily assembled and disassembled by simply screwing or unscrewing the set screw 9.

Both lock heads 6 and 8 have eyes 5 and 7 respectively, so that the barbell can be hung on a peg or nail on a wall while it is not in use.

The manner of operation of the apparatus will now be described.

The shape of the barbell described provides a barbell having its mass distributed over a conveniently shaped volume, without reducing the overall weight of the barbell. The shape is such that when the weight is lifted by the user gripping the hand-grip portions 3 and 4, the barbell can be lifted in such a manner as to allow the bar to pass close to the chest of the user during use.

Although the bar 1 is a good fit in the hole 12 of the weight 2, the weight is arranged to be capable of rotary movement relative to the axis of the bar. The cavity 14 produces an eccentricity in the centre of gravity of the weight 2 which is made to be just enough to overcome the friction-force between the bar and the weight during lifting of the barbell in exercise. During normal exercise the bar is not lifted directly upwards, but there is a small rotary movement due to the bending of the arms. The eccentricity of the weight produces enough turning force of the weight to overcome friction between the bar and the weight, so that the weight 2 will rotate on the bar instead of causing the bar to rotate at the end of the lifting movement, and thus avoiding or reducing the twisting shock applied to the wrists of the user. Preferably the eccentricity of the centre of gravity of the weight is just enough to overcome the friction force between the bar and the weight.

I claim:

1. A barbell comprising a bar, an elongated weight of substantially square transverse cross section axially mounted on the bar, hand-grip regions of the bar for gripping by the user during a lifting exercise, the hand-grip regions being positioned one on either side of the weight, and a cavity in the weight for displacing the center of gravity of the weight eccentrically of the axis of the weight, whereby the weight allows the bar to pass close to the chest of the user during the exercise.

2. The barbell according to claim 1, wherein the weight is capable of rotary movement about the bar, and the cavity displaces the centre of gravity of the weight sufficiently for the weight to rotate thereby about the bar during the lifting by the user.

3. The barbell according to claim 2, in which the centre of gravity of the weight is displaced by an amount such that the rotary force on the weight due to its moment of inertia during the lifting by the user is just sufficient to overcome friction between the weight and the bar.

* * * * *